US012496499B2

(12) United States Patent
Hsiao et al.

(10) Patent No.: US 12,496,499 B2
(45) Date of Patent: Dec. 16, 2025

(54) GOLF CLUB HEAD

(71) Applicant: ADVANCED INTERNATIONAL MULTITECH CO., LTD., Kaohsiung (TW)

(72) Inventors: Te-Fu Hsiao, Kaohsiung (TW); Pei-Yao Lin, Kaohsiung (TW); Min-Tsung Chen, Kaohsiung (TW); Ming-Fu Su, Kaohsiung (TW)

(73) Assignee: ADVANCED INTERNATIONAL MULTITECH CO., LTD., Kaohsiung (TW)

( * ) Notice: Subject to any disclaimer, the term of this patent is extended or adjusted under 35 U.S.C. 154(b) by 0 days.

(21) Appl. No.: 17/994,919

(22) Filed: Nov. 28, 2022

(65) Prior Publication Data

US 2023/0415005 A1 Dec. 28, 2023

(30) Foreign Application Priority Data

Jun. 27, 2022 (TW) ..... 111123854
Aug. 17, 2022 (TW) ..... 111130975

(51) Int. Cl.
*A63B 53/04* (2015.01)

(52) U.S. Cl.
CPC ..... *A63B 53/0466* (2013.01); *A63B 53/0433* (2020.08); *A63B 53/0437* (2020.08); *A63B 53/0458* (2020.08); *A63B 2209/02* (2013.01)

(58) Field of Classification Search
CPC ..... A63B 53/0466; A63B 53/0458; A63B 53/0437; A63B 53/0433
See application file for complete search history.

(56) References Cited

U.S. PATENT DOCUMENTS

| | | | | |
|---|---|---|---|---|
| 5,405,137 | A * | 4/1995 | Vincent | A63B 53/04 473/342 |
| 5,425,538 | A * | 6/1995 | Vincent | A63B 53/0466 473/347 |
| 8,444,504 | B2 * | 5/2013 | Chao | A63B 53/0466 473/332 |
| 9,908,014 | B1 * | 3/2018 | Wester | A63B 60/00 |
| 2014/0274446 | A1 * | 9/2014 | Greaney | A63B 53/06 473/307 |

* cited by examiner

*Primary Examiner* — Raeann Gorden
(74) *Attorney, Agent, or Firm* — MUNCY, GEISSLER, OLDS & LOWE, P.C.

(57) ABSTRACT

A golf club head includes a club head main body, a club head complementary component, and a protection component. The club head main body defines an opening which includes an inner opening section and an outer opening section spatially connected to and located outside the inner opening section. The club head complementary component is disposed in the inner opening section and connected to the club head main body. The protection component is disposed in the outer opening section and connected to the club head complementary component to cover the club head complementary component. The protection component is made of a carbon fiber impregnated with thermoplastic polyurethane, and has a Shore D hardness ranging from 40 to 70.

9 Claims, 4 Drawing Sheets

GOLF CLUB HEAD

CROSS-REFERENCE TO RELATED APPLICATION

This application claims priority to Taiwanese Invention Patent application Nos. 111123854 and 111130975, filed on Jun. 27, 2022 and Aug. 17, 2022, respectively.

FIELD

The disclosure relates to a golf equipment, and more particularly to a golf club head.

BACKGROUND

In order to serve different purposes in different stages of a golf tournament, a golf club head is generally divided into many different types according to functions thereof. For example, a fairway wood golf club head generally includes a club head main body which defines a plurality of openings, and a plurality of club head complementary components respectively disposed in the openings, by bonding, welding, etc. The club head complementary components might be striking face portion, a crown, a sole, or a heel.

However, such club head complementary components often, due to actions by a user, e.g., repeated hitting, wrong hitting, and accidental impact of hitting, being scratched or cracked, which not only adversely affect the appearance of the golf club head, but also reduce structural strength or bring damage to the golf club head. When the club head complementary components burst open due to severe cracks, scattered shards or fragments thereof might cause injury to the user or persons nearby, and thus, the golf club head still needs to be improved.

SUMMARY

Therefore, an object of the present disclosure is to provide a golf club head that can alleviate at least one of the drawbacks of the prior art.

According to the present disclosure, the golf club head includes a club head main body, a club head complementary component, and a protection component. The club head main body defines an opening which includes an inner opening section and an outer opening section spatially connected to and located outside the inner opening section. The club head complementary component is disposed in the inner opening section and connected to the club head main body. The protection component is disposed in the outer opening section and connected to the club head complementary component to cover the club head complementary component. The protection component is made of a carbon fiber impregnated with thermoplastic polyurethane, and has a Shore D hardness ranging from 40 to 70.

BRIEF DESCRIPTION OF THE DRAWINGS

Other features and advantages of the present disclosure will become apparent in the following detailed description of the embodiment(s) with reference to the accompanying drawings. It is noted that various features may not be drawn to scale.

DETAILED DESCRIPTION

Figure 1:
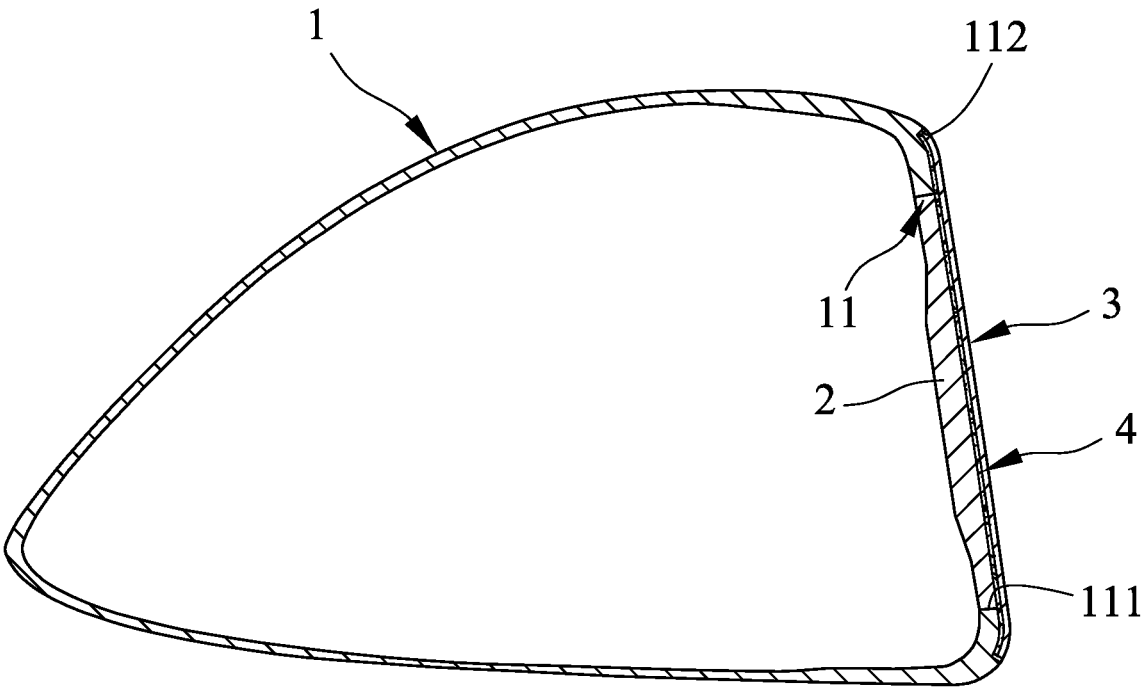
FIG. 1 is a schematic sectional view illustrating an embodiment of a golf club head according to the present disclosure.

Before the present disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
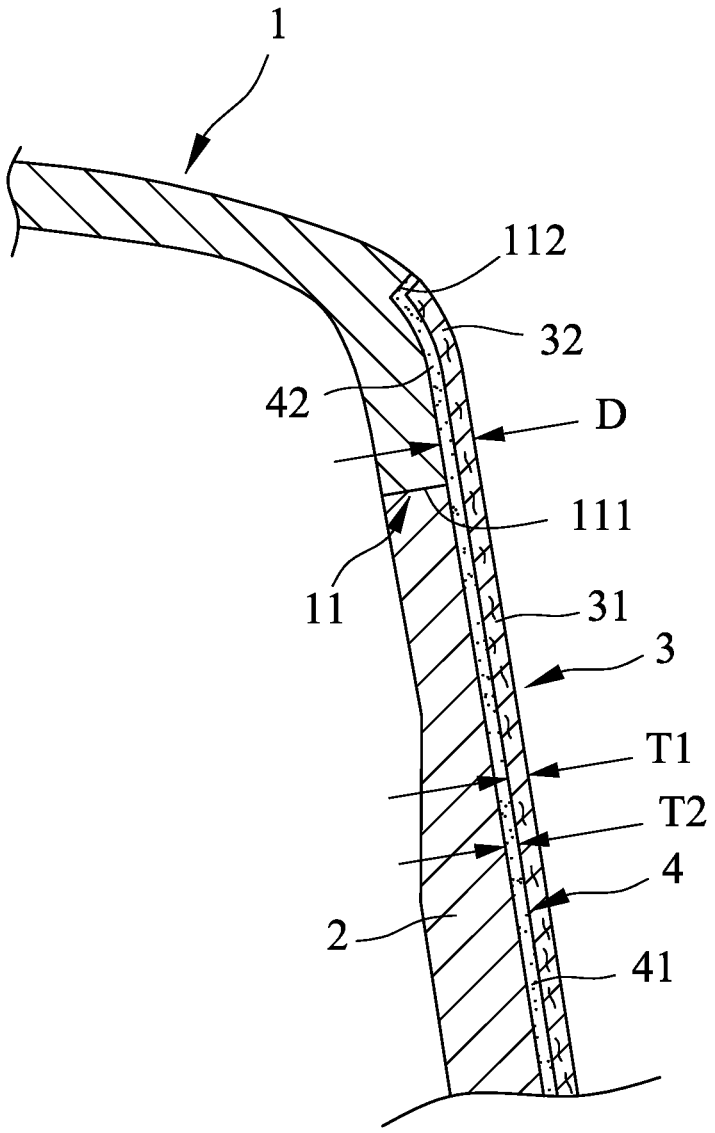
FIG. 2 is an enlarged fragmentary view of FIG. 1, illustrating a club head complementary component, a protection component and an adhesive layer of the golf club head according to the present disclosure.

Referring to FIGS. 1 and 2, an embodiment of a golf club head according to the present disclosure includes a club head main body 1 which defines an opening 11, a club head complementary component 2 disposed in the opening 11, a protection component 3 disposed in the opening 11 and connected to the club head complementary component 2 to cover the club head complementary component 2, and an adhesive layer 4 disposed between the club head complementary component 2 and the protection component 3 so as to connect the club head complementary component 2 to the protection component 3. The opening 11 includes an inner opening section 111, and an outer opening section 112 spatially connected to and located outside the inner opening section 111. The inner opening section 111 has a diameter or dimension that is less than or equal to that of the outer opening section 112. In this embodiment, the outer opening section 112 has a depth (D) ranging from 0.4 mm to 2.3 mm. In some embodiments, the opening 11 is formed to expose an interior of the club head main body 1. In other embodiments, a recess (not shown) formed in an outer surface of the club head main body 1 may have the opening 11.

Figure 3:
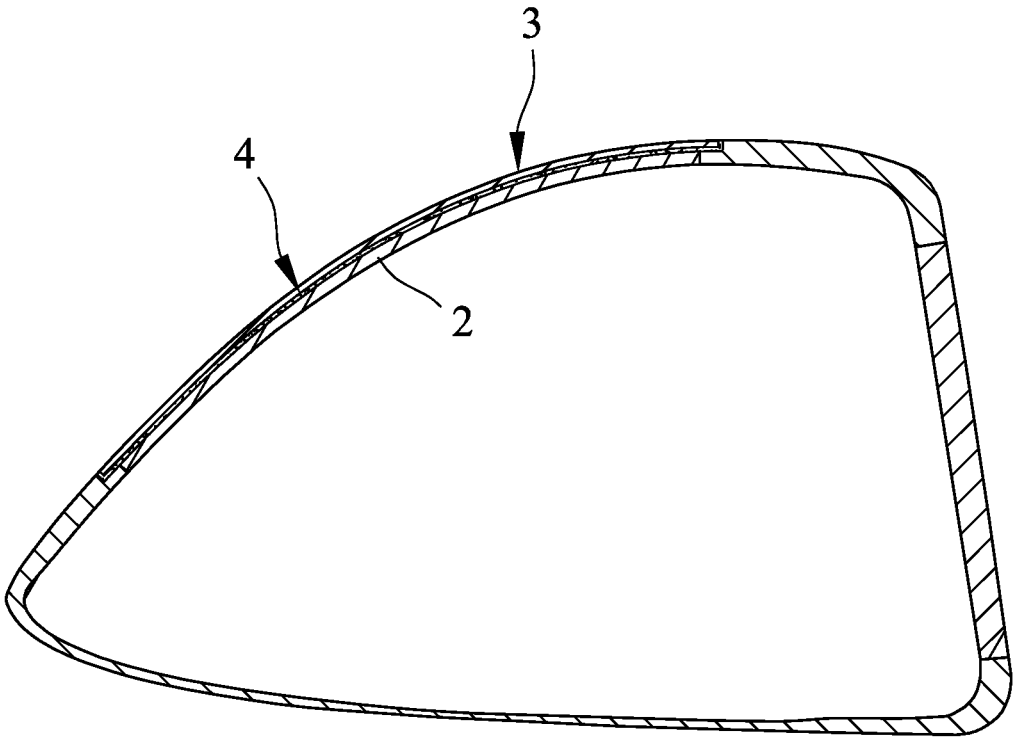
FIG. 3 is a schematic sectional view illustrating a variation of the embodiment, in which the club head complementary component is a crown.
Figure 4:
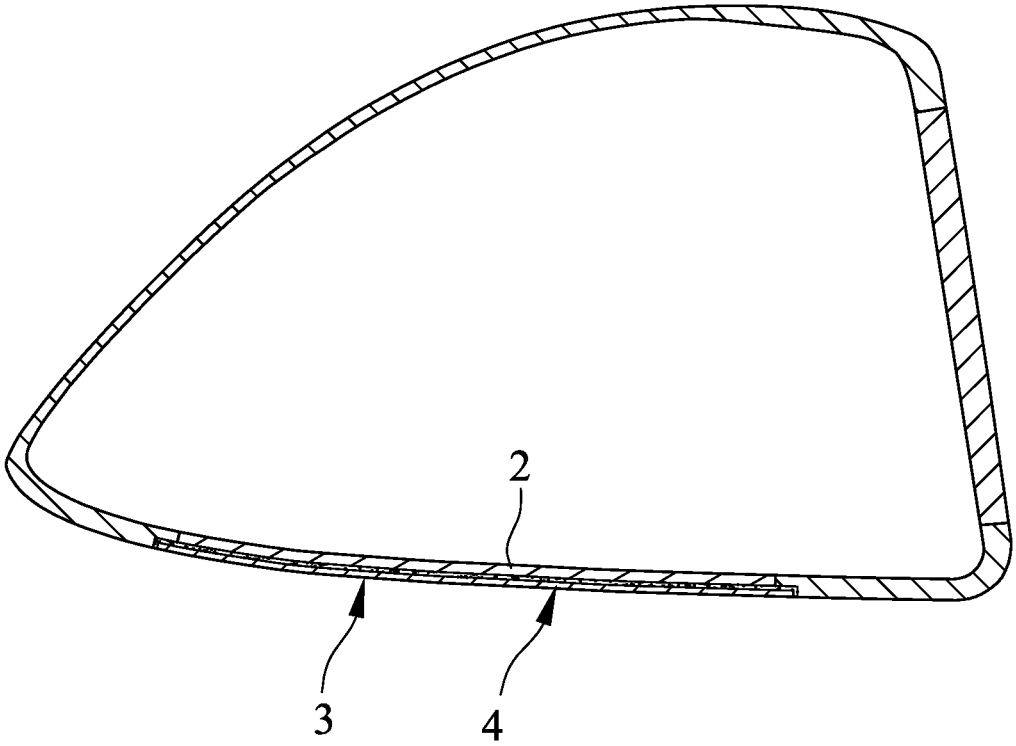
FIG. 4 is a schematic sectional view illustrating another variation of the embodiment, in which the club head complementary component is a sole.

Referring to FIGS. 1, 2 and 4, the club head complementary body 2 is disposed and fitted in the inner opening section 111, and may be one of a striking face portion (see FIG. 1), a crown (see FIG. 3), a sole (see FIG. 4) or a heel (not shown). In this embodiment, the club head complementary body 2 is made of a metallic material in order to have the advantages of light weight and great strength. In certain embodiments, the club head complementary body 2 is made of a non-metallic material, such as plastics, resin-containing carbon fiber, glass fiber, etc.

Referring back to FIGS. 1 and 2, the protection component 3 is disposed and fitted in the outer opening section 112, and includes a central protection portion 31 and a peripheral protection portion 32. The central protection portion 31 is connected to and completely covers the club head complementary component 2, and has a diameter or dimension equal to that of the club head complementary component 2. The peripheral protection portion 32 extends outwardly from the central protection portion 31, and is connected to the club head main body 1. In addition, the peripheral protection portion 32 has an inner surface facing the club head main body 1, and a peripheral surface angularly extending from the inner surface. In some embodiments, the peripheral protection portion 32 further has an outer surface opposite to the inner surface, and the peripheral surface extends between the inner and outer surfaces. In this embodiment, the protection component 3 has a thickness (T1) ranging from 0.3 mm to 2.0 mm, is made of a carbon fiber impregnated with thermoplastic polyurethane, and has a Shore D hardness ranging from 40 to 70.

The adhesive layer 4 is disposed in outer opening section 112, and includes a central bonding portion 41 sandwiched between the club head complementary component 2 and the central protection portion 31, and a peripheral bonding portion 42 which extends outwardly from and is connected to the central bonding portion 41 and which is sandwiched between the club head main body 1 and the peripheral protection portion 32. To be specific, the peripheral bonding portion 42 is attached to the inner surface and the peripheral surface of the peripheral protection portion 32 of the protection component 3. The adhesive layer 4 may be one of a heat-activated adhesive sheet or a two-part reactive adhesive. The two-part reactive adhesive may be referred to a two-part epoxy adhesive, a two-part structural adhesive, or a two part-reactive epoxy adhesive, and may include two different components which are each in the form of liquid, and which can react with each other. In this embodiment, the adhesive layer 4 is a heat-activated adhesive sheet which allows a uniform thickness thereof, so as to avoid variation in thickness affecting the hitting of a golf ball. The adhesive layer 4 may have a thickness (T2) ranging from 0.1 mm to 0.3 mm. It should be noted that, when the club head complementary component 2 is made of a non-metallic material, the club head complementary component 2 may be directly connected to the protection component 3 by press-bonding without use of the adhesive layer 4 therebetween, and in this case, the depth (D) of the outer opening section 112 may range from 0.3 mm to 2.0 mm.

In summary, in the golf club head of the present disclosure, the protection component 3 covers the club head complementary component 2 to provide protective effects, i.e., preventing the club head complementary component 2 from being scratched or cracked, and preventing injury to the user and/or persons nearby when the club head complementary component 2 bursts open, and with the protection component 3 being made of the carbon fiber fabric impregnated with thermoplastic polyurethane, the golf club head is not only provided with good aesthetic appearance, but also is conferred with toughness, strength and durability characteristics. When the club head complementary component 2 is a striking face portion, softness characteristic imparted by thermoplastic polyurethane allows the protection component 3 to produce more compression and deformation effects compared to those of a conventional golf club head having a striking plate made from a metallic material, and thus, repulsion and backspin of a golf ball may be adjusted, and ball touch and ball grip can be improved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A golf club head, comprising:

a club head main body defining an opening which includes an inner opening section and an outer opening section spatially connected to and located outside said inner opening section;

a club head complementary component fittingly engaged within said inner opening section and connected to said club head main body;

a protection component disposed in said outer opening section and connected to said club head complementary component to cover said club head complementary component, said protection component being made of a carbon fiber fabric impregnated with thermoplastic polyurethane, and having a Shore D hardness ranging from 40 to 70; and an adhesive layer disposed between said club head complementary component and said protection component so as to connect said club head complementary component to said protection component, wherein in said opening, said inner opening section has a diameter that is less than that of said outer opening section, wherein said adhesive layer is disposed in said outer opening section, wherein said protection component includes a central protection portion which is connected to and completely covers said club head complementary component and which has a dimension equal to that of said club head complementary component, and a peripheral protection portion which extends outwardly from said central protection portion and which is connected to said club head main body, wherein said adhesive layer includes a central bonding portion sandwiched between said club head complementary component and said central protection portion, and a peripheral bonding portion which extends outwardly from and is connected to said central bonding portion and which is sandwiched between said club head main body and said peripheral protection portion, wherein said peripheral protection portion has an inner surface facing said club head main body, and a peripheral surface angularly extending from said inner surface to define a periphery of said protection component, said peripheral bonding portion being attached to said inner surface and said peripheral surface of said peripheral protection portion, wherein said adhesive layer has a thickness ranging from 0.1 mm to 0.3 mm;

wherein a thickness of said club head complementary component is greater than a thickness of said protection component, wherein a maximum thickness of said club head main body is not greater than a maximum thickness of said club head complementary component, and wherein said club head main body and said club head complementary component are made of different materials.

2. The golf club head as claimed in claim 1, wherein the adhesive layer is selected from the group consisting of a heat-activated adhesive sheet and a two-part reactive adhesive.

3. The golf club head as claimed in claim 1, wherein said club head complementary component is selected from the group consisting of a striking face portion, a crown, a sole, and a heel.

4. The golf club head as claimed in claim 1, wherein said club head complementary component is made of a metallic material.

5. The golf club head as claimed in claim 1, wherein said club head complementary component is made of a non-metallic material.

6. The golf club head as claimed in claim 1, wherein said outer opening section has a depth ranging from 0.3 mm to 2.3 mm.

7. The golf club head as claimed in claim 1, wherein said protection component has a thickness ranging from 0.3 mm to 2.0 mm.

8. The golf club head as claimed in claim 1, wherein said adhesive layer is absent in said inner opening section.

9. The golf club head as claimed in claim 1, wherein a minimum thickness of said club head main body is less than a maximum thickness of said club head complementary component.

* * * * *